US005465513A

United States Patent [19]

Sonerud

[11] Patent Number: 5,465,513

[45] Date of Patent: Nov. 14, 1995

[54] DEVICE FOR QUICK CONNECTION OF HYDRAULIC TUBINGS

[76] Inventor: John T. Sonerud, Vintervägen 30, S-824 00 Hudiksvall, Sweden

[21] Appl. No.: 199,314

[22] PCT Filed: Aug. 25, 1992

[86] PCT No.: PCT/SE92/00586

§ 371 Date: Mar. 8, 1994

§ 102(e) Date: Mar. 8, 1994

[87] PCT Pub. No.: WO94/02184

PCT Pub. Date: Feb. 3, 1994

[30] Foreign Application Priority Data

Sep. 6, 1991 [SE] Sweden ..... 9102566

[51] Int. Cl.[6] ..... B66C 23/00

[52] U.S. Cl. ..... 37/468; 37/403; 414/723

[58] Field of Search ..... 37/468, 403, 404, 37/405, 406, 407; 172/245, 250, 253; 414/723; 403/31, 322; 285/18, 25, 28

[56] References Cited

U.S. PATENT DOCUMENTS

| | | | |
|---|---|---|---|
| 4,142,642 | 3/1979 | Myers | 414/723 X |
| 4,630,878 | 12/1986 | Heine et al. | 339/75 |
| 4,632,595 | 12/1986 | Schaeff | 403/322 X |
| 5,082,389 | 1/1992 | Balemi | 403/322 |
| 5,108,252 | 4/1992 | Gilmore, Jr. et al. | 414/723 X |
| 5,147,173 | 9/1992 | Fauber et al. | 403/322 X |
| 5,237,762 | 8/1993 | Sandberg | 37/403 X |
| 5,242,258 | 9/1993 | Weyer | 414/723 |
| 5,333,400 | 8/1994 | Sonerud | 37/468 |
| 5,360,313 | 11/1994 | Gilmore, Jr. et al. | 414/723 X |
| 5,387,075 | 2/1995 | Aoki | 403/322 X |

*Primary Examiner*—Terry Lee Melius
*Assistant Examiner*—Victor Batson
*Attorney, Agent, or Firm*—Watson, Cole, Grindle & Watson

[57] ABSTRACT

In the process of soil excavating work or like work with the use of excavators and loaders, it is becoming more usual to use different hydraulically functioning implements. It is often necessary to exchange these implements several times during a working day, necessitating the driver to connect and disconnect the hydraulic hoses involved manually, which can be a time-consuming task and one which is encumbered with the risk of oil spilling from the hoses and generally soiling the clothing of the workman involved, tools and the surrounding ground. The hydraulic hoses that hang loosely from the removed implement are easily damaged and foreign particles and contaminating particles are able to enter the unprotected and to simplify connection of hydraulic hose couplings (8, 9) to different implements having hydraulic functions when using an implement quick-coupling arrangement (1) fitted to an excavator, digger or like machine, the couplings have been positioned in a protected place in the quick-coupling arrangement (1) itself and the connection is arrangement so the when the movable part (6) of the quick-coupling moves in an implement coupling or implement uncoupling direction, the hydraulic couplings which are operative in powering movement of the implement will be connected or disconnected at the same time.

6 Claims, 1 Drawing Sheet

DEVICE FOR QUICK CONNECTION OF HYDRAULIC TUBINGS

TECHNICAL FIELD

The present invention relates to a quick-coupling arrangement for effecting connection of an implement to heavy-duty machinery such as an excavating machine, digger or like machine and simultaneously connecting a power system to the implement.

BACKGROUND ART

In the process of soil excavating work or like work with the use of excavators and loaders, it is becoming more usual to use different hydraulically functioning implements, such as slope shovels, special-duty shovels, percussion hammers and pallet handling forks. It is often necessary to exchange these implements several times during a working day, necessitating the driver to connect and disconnect the hydraulic hoses involved manually, which can be a time-consuming task and one which is encumbered with the serious risk of oil spilling from the hoses and generally soiling the clothing of the workman involved, tools and the surrounding ground. The hydraulic hoses that hang loosely from the removed implement are easily damaged and foreign particles and contaminating particles are able to enter the unprotected fittings. When the implement concerned is next fitted to the machine, these impurities will be drawn into the hydraulic system of the machine and may cause serious damage to the hydraulic system, which is often very sensitive, resulting in unnecessary damage and operational breakdowns. The majority of present-day excavators are often fitted with a shovel quick-coupling arrangement which includes a mechanical or a hydraulic locking means.

In order to enable a power or drive system to be connected automatically to a working implement fitted to an excavator, digger or like machine, hydraulic quick-coupling devices are often used for coupling and connecting the implements directly from the driving cabin during the excavation work. In order to enable an implement to be coupled quickly and readily to the excavator while, at the same time, connecting a power fluid supply to the implement, that part of the machine which is pivotally connected to the digging arm and the shovel or implement link is provided with one or more connecting and coupling parts, for instance female-type hydraulic couplings. The implement to be coupled to this part is provided with corresponding male-type hydraulic couplings. Subsequent to having fitted the implement, for instance to one side of the part and having rotated the implement so as to couple the other side of the implement firmly to the other side of the part, the male and female hydraulic coupling elements are brought together simultaneously, such as to hold the coupling elements together by the connection of the implement to the excavator part and the locking of the implement to the part. Coupling of an implement to an excavator need not be dependent on hydraulic functions, but may be accomplished purely mechanically.

SUMMARY OF THE INVENTION

With the intention of providing better protection for hydraulic hose couplings and to simplify the connection of such couplings to different implements having hydraulic functions with the aid of an implement quick-coupling fitted to an excavator, digger or like machine, the couplings have been positioned in a protected place in the quick-coupling arrangement itself and the connection is arranged so that when the quick-coupling moves in an implement coupling or implement uncoupling direction, the hydraulic couplings which are operative in powering movement of the implement will be connected or disconnected at the same time.

Thus, a driver is able to connect or disconnect an implement directly from the driving cabin of an excavating machine and the hydraulic system will be connected or disconnected at the same time as the quick-coupling is used to connect or disconnect the implement.

BEST MODE OF CARRYING OUT THE INVENTION

Figure 1:
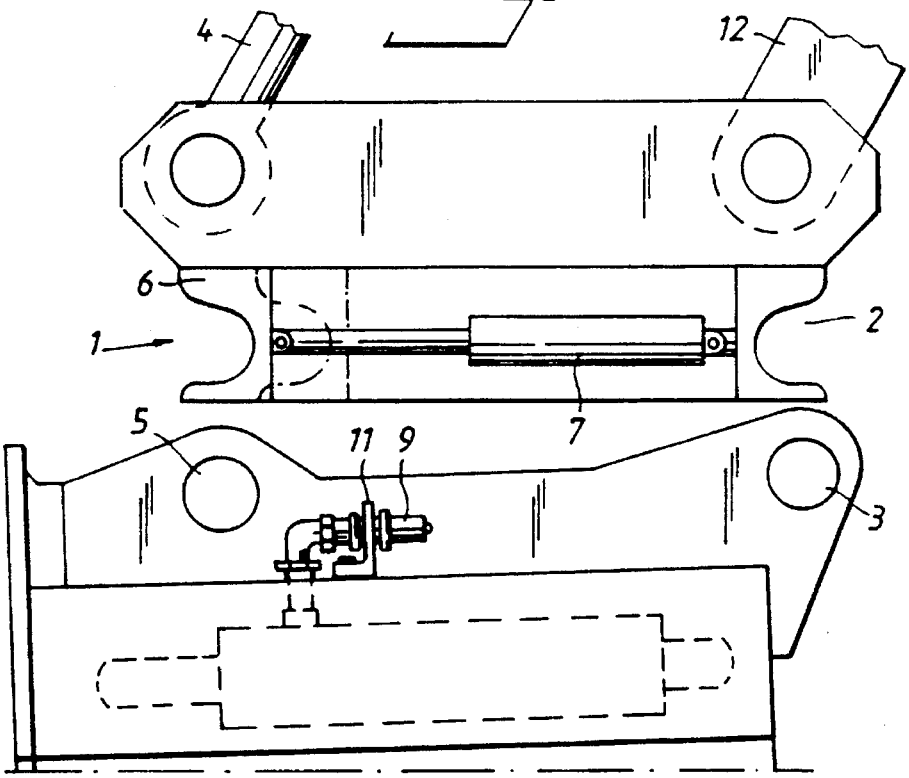
FIG. 1 is in accordance with the invention a side view of the upper part of an implement, for instance a digging shovel having a hydraulic connection on the roof of the shovel, and a digging arm which is connected to a digging shovel.
Figure 2:
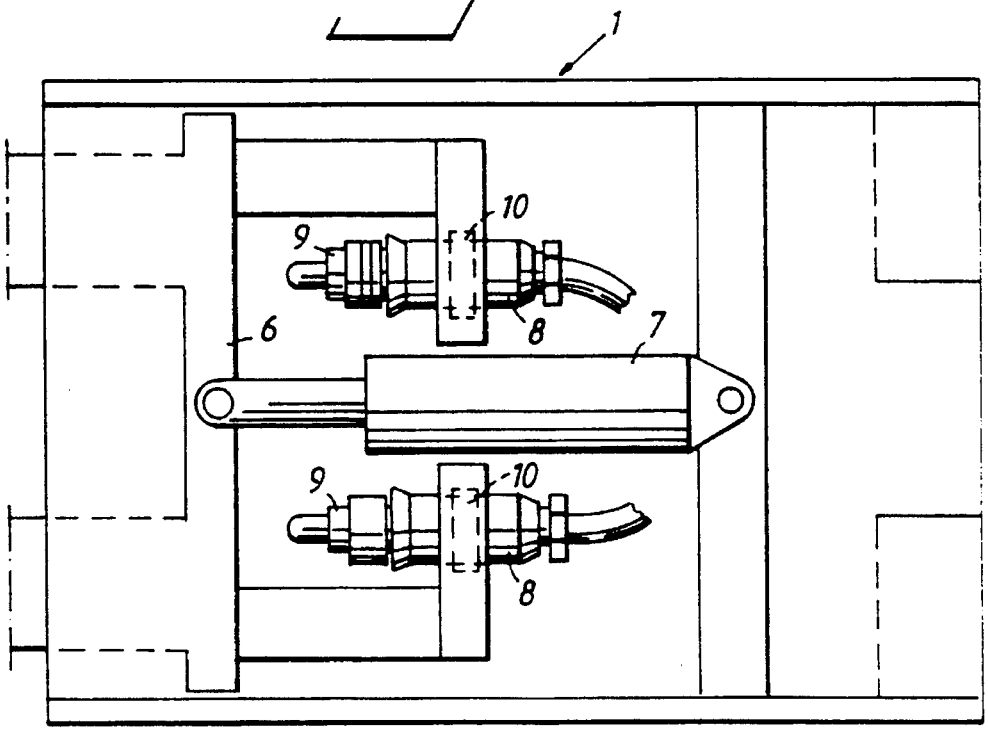
FIG. 2 illustrates in accordance with the invention a shovel quick-coupling which incorporates hose couplings.

The illustrated implement quick-coupling arrangement for excavating machines in accordance with the invention includes a hydraulic connection and is manoeuvered hydraulically. However, the illustrated quick-coupling arrangement 1 may be manoeuvered manually or electromagnetically. When an implement, such as a bucket or shovel, is to be coupled to an excavator that is provided with a digging arm 12, a fixed semi-circular recess 2 on the quick-coupling device 1 of the excavator is brought into abutment with a transverse forward bolt 3 on the shovel attachment. A piston-cylinder device 4 is then activated so that the coupling will be aligned with the other transverse rearward bolt 5 of the shovel attachment. When the coupling is correctly aligned, a movable semi-circular recess provided on a locking mechanism 6 in the coupling is moved towards the second transverse bolt 5 with the aid of at least one hydraulic piston-cylinder device 7 or at least one mechanical lever, so that the quick-coupling having the recess 2 on the lock mechanism 6 can then be fully connected with the bolt 5 and therewith affix the shovel or bucket to the shovel attachment. The quick-coupling arrangement includes one or more hydraulic hose couplings, wherein a female part of one hydraulic hose coupling is fixedly mounted on a movable part which accompanies the movement of the locking mechanism 6 in the quick-coupling arrangement. Hydraulic quick-couplings 8 may be placed on both sides of the hydraulic piston-cylinder device 7 within the quick-coupling so as to be protected to the best possible extent.

Corresponding hose coupling parts or implement (shovel) coupling parts, male parts 9, are mounted firmly on the implement, e.g. the bucket or shovel, with the aid of an attachment 11 such that the coupling parts will take positions that are suitable for receiving the female part 8 when the quick-coupling arrangement 1 is firmly locked to the bucket or shovel. As the locking mechanism 6 of the quick-coupling 1 arrangement is activated so as to hold the bucket or shovel firmly, female parts 8 are, at the same time, moved in parallel over male parts 9 and are automatically locked in a fully inserted position by locking mechanisms 10 incorporated in the female couplings. Coupling of the implement and coupling of the hydraulics are thus effected at one and the same time. When the bucket, shovel or other relevant implement is to be disconnected, the locking mechanism 6 of the quick-coupling arrangement is activated in the opposite direction and, at the same time, the locking mechanism 10 of the female part 8 is released and the female part moved from its coupled position, therewith disengaging the implement and the hydraulic coupling simultaneously.

As a result of enabling the implement and the hydraulic system to be coupled simultaneously, the implement need not be provided with actual hydraulic hoses but can be connected directly to a power cylinder or the like while the hydraulic connections in the shovel quick-coupling arrangement obtain a small movement area and are well protected from above and from the side of the actual implement coupling. When the locking mechanism moves in a straight line so as to grip and accurately fix the rear implement bolt, the hydraulic hose couplings will move forwards under power and will accompany the movement in parallel, thereby achieving extremely good alignment and guiding of the couplings towards the couplings on the implement, thereby connecting the implement hydraulically to the excavator in a reliable and safe fashion.

I claim:

1. An arrangement for quickly coupling a working implement to a heavy-duty machine and simultaneously connecting a hydraulic power system to the implement, wherein a coupling arrangement, which functions to lock and hold the implement, carries at least one first working fluid coupling means, wherein, as the coupling arrangement locks and holds said implement, the first coupling means is connected with a second coupling means mounted on the implement so as to connect said working fluid coupling means with said implement, wherein the first fluid coupling means is fixedly mounted on a movable part of the coupling arrangement, the movable part being connected to and accompanies the movement of a locking and holding mechanism, and wherein the second fluid coupling means is fixedly connected to said implement, wherein, as the locking and holding mechanism is correctly aligned for correct coupling, said locking and holding mechanism is arranged to move, to lock and hold the implement, and at the same time the first fluid coupling means is arranged to move in parallel with the last-mentioned movement towards the second fluid coupling means to connect the first and second fluid coupling means to each other.

2. An arrangement according to claim 1, including means for moving the movable part to connect the implement to or disconnect the implement from the heavy-duty machine by the locking and holding mechanism while at the same time connect an operating fluid source to or disconnect an operating fluid source from the implement by the fluid coupling means.

3. An arrangement according to claim 2, wherein said means for moving the movable part is comprised of at least one hydraulic piston-cylinder device or mechanical lever connected to the locking and holding mechanism and carrying the operating fluid coupling means via the movable part.

4. The combination of an accessory for an excavator and a quick-connect coupling device which is attachable to an arm of the excavator for connecting the accessory to the excavator, said accessory including first and second mounting means, and a first hydraulic lines having first hydraulic coupling means, and said coupling device including third and fourth mounting means and second hydraulic lines having second hydraulic coupling means connected to said third mounting means, and drive means for moving the third mounting means relative to the fourth mounting means, said third and fourth mounting means of said coupling device being cooperable with said first and second mounting means of said accessory and said second hydraulic coupling means of said coupling device being cooperable with said first hydraulic coupling means of said accessory such that during connection said fourth mounting means of said coupling means can be pivotally connected to said second mounting means of said accessory and thereafter said coupling device can be pivoted about said second mounting means until said third mounting means of said coupling means becomes aligned with said first mounting means of said accessory, whereafter said drive means moves said third mounting means into engagement with said first mounting means to fixedly couple said accessory to said coupling device, said second hydraulic coupling means simultaneously moving against and locking with said first coupling means, thereby enabling drive fluid to be delivered from said coupling means to said accessory.

5. The combination as defined in claim 4 wherein said drive means comprises a hydraulic piston/cylinder device.

6. The combination as defined in claim 4, wherein said first and second mounting means comprise spaced parallel bolts fixedly attached to said accessory, and wherein said third and fourth mounting means comprise spaced elements defining recesses that can respectively fit against and around said bolts.

* * * * *

UNITED STATES PATENT AND TRADEMARK OFFICE

CERTIFICATE OF CORRECTION

PATENT NO. : 5,465,513

DATED : November 14, 1995

INVENTOR(S) : John T. Sonerud

It is certified that error appears in the above-indentified patent and that said Letters Patent is hereby corrected as shown below:

On the title page, item

[87] PCT Pub. No.: WO 93/05241
PCT Pub. Date: March 18, 1993

Signed and Sealed this

Twentieth Day of February, 1996

*Attest:*

*Attesting Officer*

BRUCE LEHMAN

*Commissioner of Patents and Trademarks*